US006651399B2

(12) United States Patent
Li

(10) Patent No.: US 6,651,399 B2
(45) Date of Patent: Nov. 25, 2003

(54) VERTICAL INTERSECTING LIGHTWEIGHT STEEL FRAME

(76) Inventor: Jui-Jung Li, 7F-2, No. 181, Sec. 4, Xin I Rd., Taipei (TW)

( * ) Notice: Subject to any disclaimer, the term of this patent is extended or adjusted under 35 U.S.C. 154(b) by 31 days.

(21) Appl. No.: 09/994,058

(22) Filed: Nov. 27, 2001

(65) Prior Publication Data

US 2003/0097809 A1 May 29, 2003

(51) Int. Cl.[7] ..... E04B 9/00

(52) U.S. Cl. ..... 52/506.07; 52/667; 52/726.1; 52/729.5

(58) Field of Search ..... 52/506.07, 506.08, 52/506.09, 506.1, 664, 667, 726.1, 729.5

(56) References Cited

U.S. PATENT DOCUMENTS 4,535,580 A * 8/1985 Shirey ..... 52/484
4,549,383 A * 10/1985 Vukmanic et al. ..... 52/667
5,154,031 A * 10/1992 Wall ..... 52/484

* cited by examiner

*Primary Examiner*—Carl D. Friedman
*Assistant Examiner*—Naoko Slack
(74) *Attorney, Agent, or Firm*—Jacobson Holman PLLC

(57) ABSTRACT

A vertical intersecting lightweight steel frame includes several main frames and side frames, which are connected with each other vertically. A first oblique fold is formed on two sides of the main frame and a protrusion is on the bottom of the side frame. The angle of the first oblique fold on both sides of the indention of the main frame is less than 45 degrees. A second oblique fold above the first oblique fold has an angle of 45 degrees. The angle of the protrusion of the side frame is also 45 degrees. The whole structure is stronger and easier to assemble. A darkened area of the vertical connection between the main frame and side frame is kept hidden.

2 Claims, 5 Drawing Sheets

VERTICAL INTERSECTING LIGHTWEIGHT STEEL FRAME

BACKGROUND OF THE INVENTION

I. Field of the Invention

This invention relates generally to a vertical intersecting lightweight steel frame and, more specifically, to a vertical intersecting lightweight steel frame composed of several main frames and side frames, both frames have a elongated groove on the bottom. The mid portion of the main frame has a plurality of joint slots. A first oblique fold is formed vertically under the joint slot. An inserting tongue is on both ends of the side frame. A protrusion is stretched out from the flap of the side frame. The angle of the first oblique fold on both sides of the indention of the main frame is less than 45 degrees. A second oblique fold above the first oblique fold has an angle of 45 degrees. The angle of the protrusion of the side frame is also 45 degrees. Such structure makes the protrusion of the side frame match and attach firmly into the second oblique fold of the main frame. The whole structure is stronger and easier to assemble. The darkened area of the vertical connection between the main frame and side frame is kept undisclosed.

II. Description of the Prior Art

Heretofore, it is known that most of the ceilings of residential houses or offices are made of metal cranes to form lightweight steel frames, and the empty spaces are filled with plastic, wood or metal plates.

The known prior art, as shown in FIG. 5, is formed with a main frame a and side frame b. Main frame a and side frame b are made of metal cranes and pressed into an I shape. On the bottom the main and side frames have flap a1, b1 respectively that are stretched out and form elongated groove a2, b2. In the mid portion of the main frame are a plurality of joint slots a3. Vertically beneath the joint slot a3 is an indentation a4 extending from the elongated groove a2. An oblique fold a5 is at the front of the indentation a4 of the main frame a. On both ends of the side frame b are inserting tongue b3. On both ends of flap b1 of side frame b are protrusion b4. The inserting tongue b3 of the side frame b inserts into joint slot a3 of the main frame. The protrusion b4 at the end of the flap b1 under the side frame b vertically fastens to the elongated groove a5 of the main frame a. Such an arrangement can make the elongated groove b2 of the side frame b connect vertically to the elongated groove a2 of the main frame a. The connection is repeted until the frame structure covers the whole ceiling.

The elongated groove a2 of the main frame a and the elongated groove b2 of the side frame b, and the oblique fold a5 of main frame are painted in a dark color to emphasize the connection lines. The oblique fold a5 on both ends of the elongated groove a4 of the main frame a is bent from flap a1. The arrangement will weaken the indentation a4 of the main frame a. The whole structure might tend to twist and be unstable.

The indention a4 of the main frame a is pressed out from the main frame a. Therefore the structure around the indention a4 might tend not to be so strong and twist easily. After the protrusion b4 of the side frame b attaches to the oblique fold a5 on the indention a4 of the main frame a, the protrusion a4 of the side frame might be out of the alignment. The sharp edge of the protrusion a4 might cause injury during assembly.

The elongated groove b4 beneath the inserting tongue b3 of the side frame b connects to the oblique fold a5 of the main frame a. The indentation a4 of the main frame a is twisted easily after assembly. Since the oblique fold a5 of the main frame a is painted dark, the twist might cause the protrusion b4 of the side frame b to incompletely cover the oblique fold a5 of the main frame. The oblique fold a5 of the main frame a will expose the darkened area.

SUMMARY OF THE INVENTION

It is therefore a primary object of the invention to provide a vertical intersecting lightweight steel frame that has a second oblique fold above the first oblique fold. Such a scheme can provide a stronger structure after the side frames are mounted on the main frame.

It is another object of this invention to provide a vertical intersecting lightweight steel frame that has a second oblique fold above the first oblique fold of the main frame. Such an arrangement can cover the cross section of the main frame and the side frame properly to avoid the darkened area from exposure.

BRIEF DESCRIPTION OF THE DRAWINGS

The accomplishment of the above-mentioned objects of the present invention will become apparent from the following description and its accompanying drawings which disclose an embodiment of the present invention, and are as follows.

DESCRIPTION OF THE PREFERRED EMBODIMENT

Figure 1:
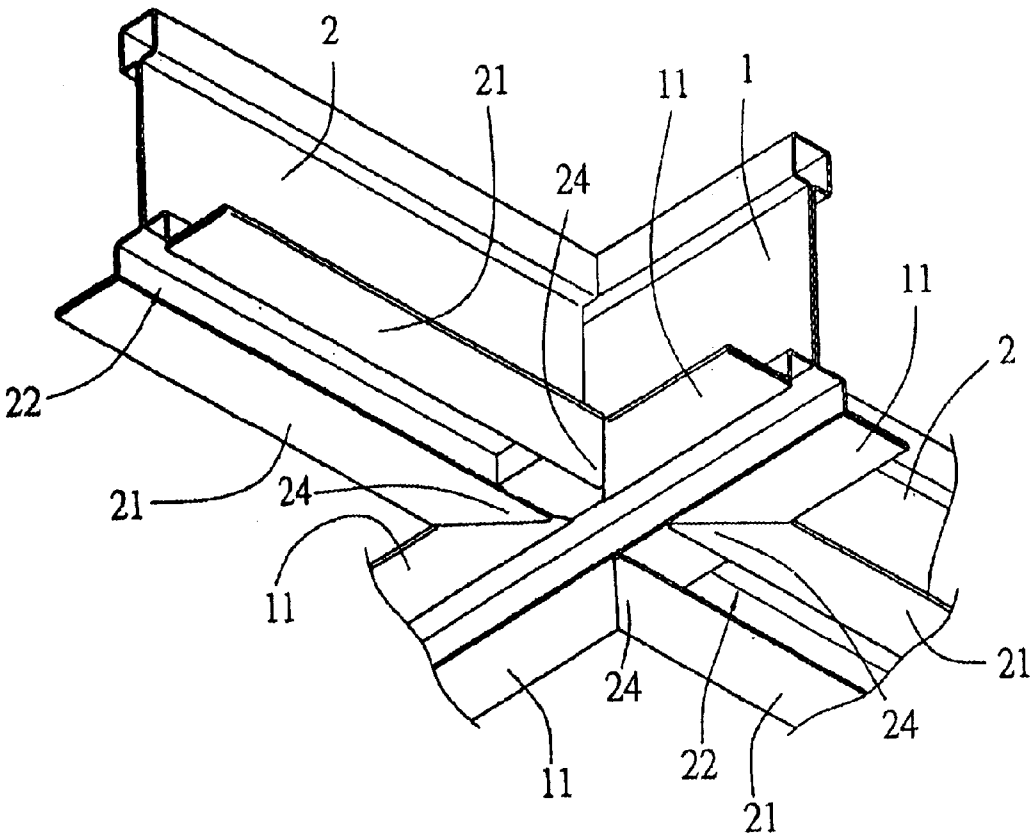
FIG. 1 is a perspective view of the present invention.
Figure 2:
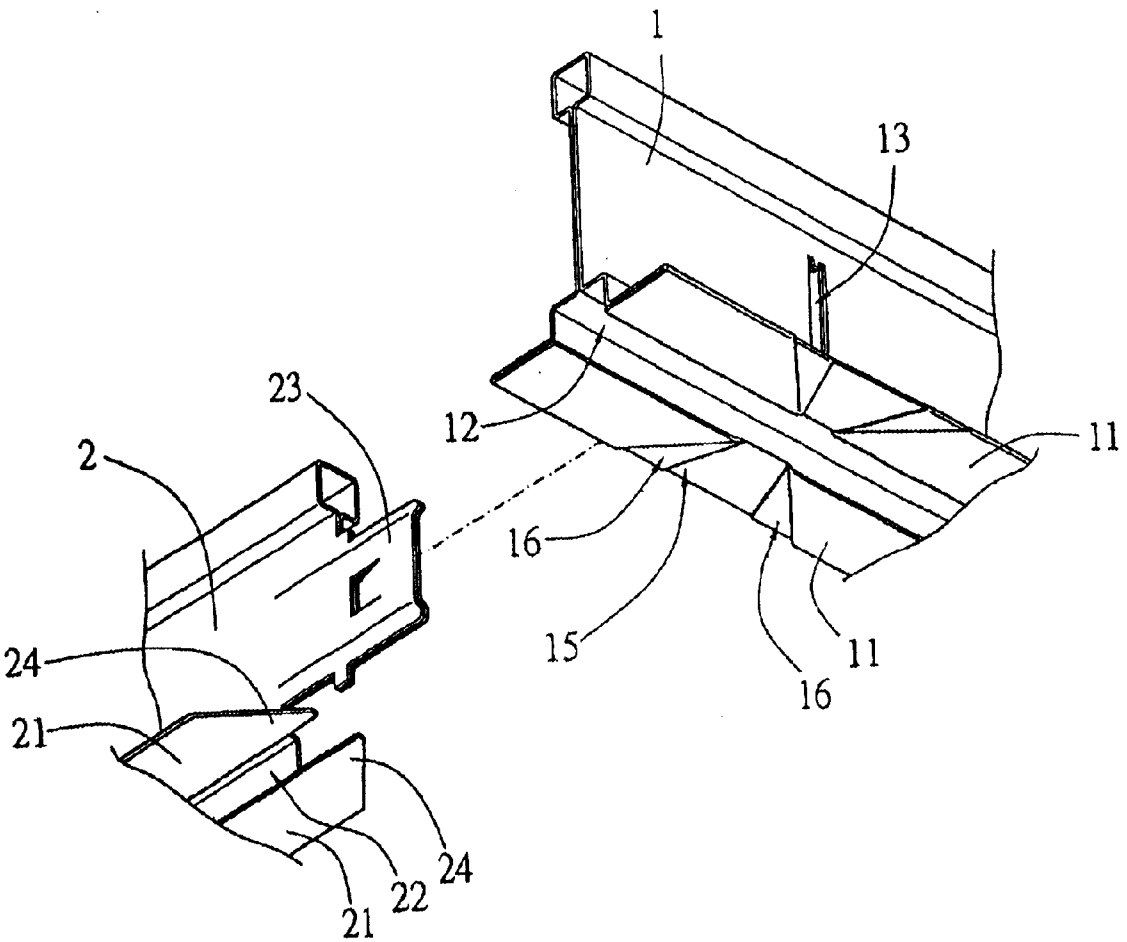
FIG. 2 is a cross section view of the present invention.
Figure 3:
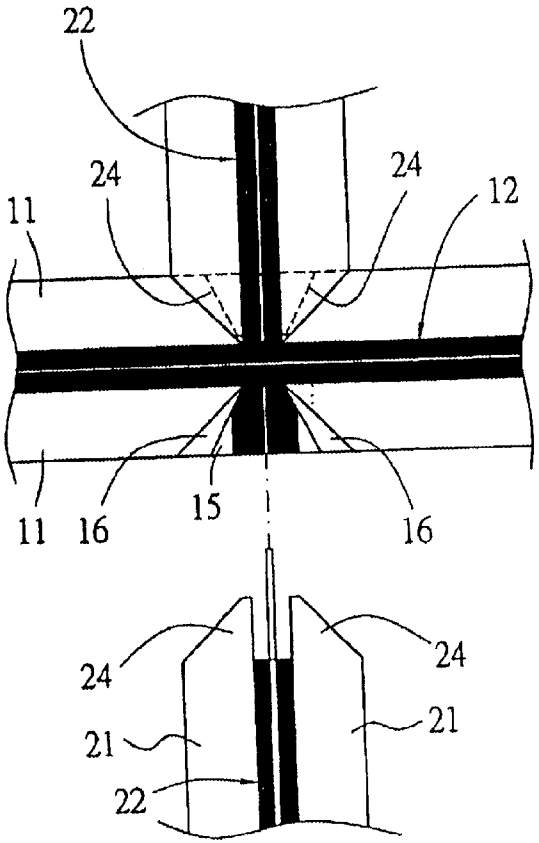
FIG. 3 is a bottom view of the present invention.

Referring to FIG. 1, FIG. 2 and FIG. 3, the present invention is composed of a main frame 1 and side frame 2. Main frame 1 and side frame 2 are made of metal and pressed into I shape.

Flap 11 and flap 21 are on both sides of the bottom of the main frame 1 and side frame 2. The pairs of flap 11 and flap 21 form elongated groove 12 and 22 on the center bottom of the frames respectively. A joint slot 13 is in the middle of the main frame 1. A first oblique fold 15 is formed vertically under the joint slot 13. An insertion tongue 23 is on each of both ends of the side frame 2. A protrusion 24 is on the end of the flap 21 on the bottom of the side frame 2. By inserting the insert tongue 23 of the side frame 2 into the joint slot 13 of the main frame 1, the protrusion 24 of the flap 21 beneath the side frame 2 is fastened to the first oblique fold 15 of the flap 11 of the main frame 1. This makes the elongated groove 22 of the side frame 2 connect vertically with the elongated groove 12 of the main frame 1. The connection is repeated until the frame structure covers the whole ceiling.

The angle of the first oblique fold 15 of the main frame 1 is less than 45 degrees. The angle of the second oblique fold 16 above the first oblique fold 15 is 45 degrees. The angle of the protrusion 24 of the side frame 2 is 45 degrees. Therefore the protrusion 24 of the side frame 2 can be firmly inserted into the second oblique fold 16 of the main frame 1.

By the above description, the structure of the second oblique fold 16 must be strengthened to avoid a twisting condition after assembly. The protrusion 24 of the side frame 2 must be placed flat on the second oblique fold 16 of the main frame 1 to avoid injury during construction.

Figure 4:
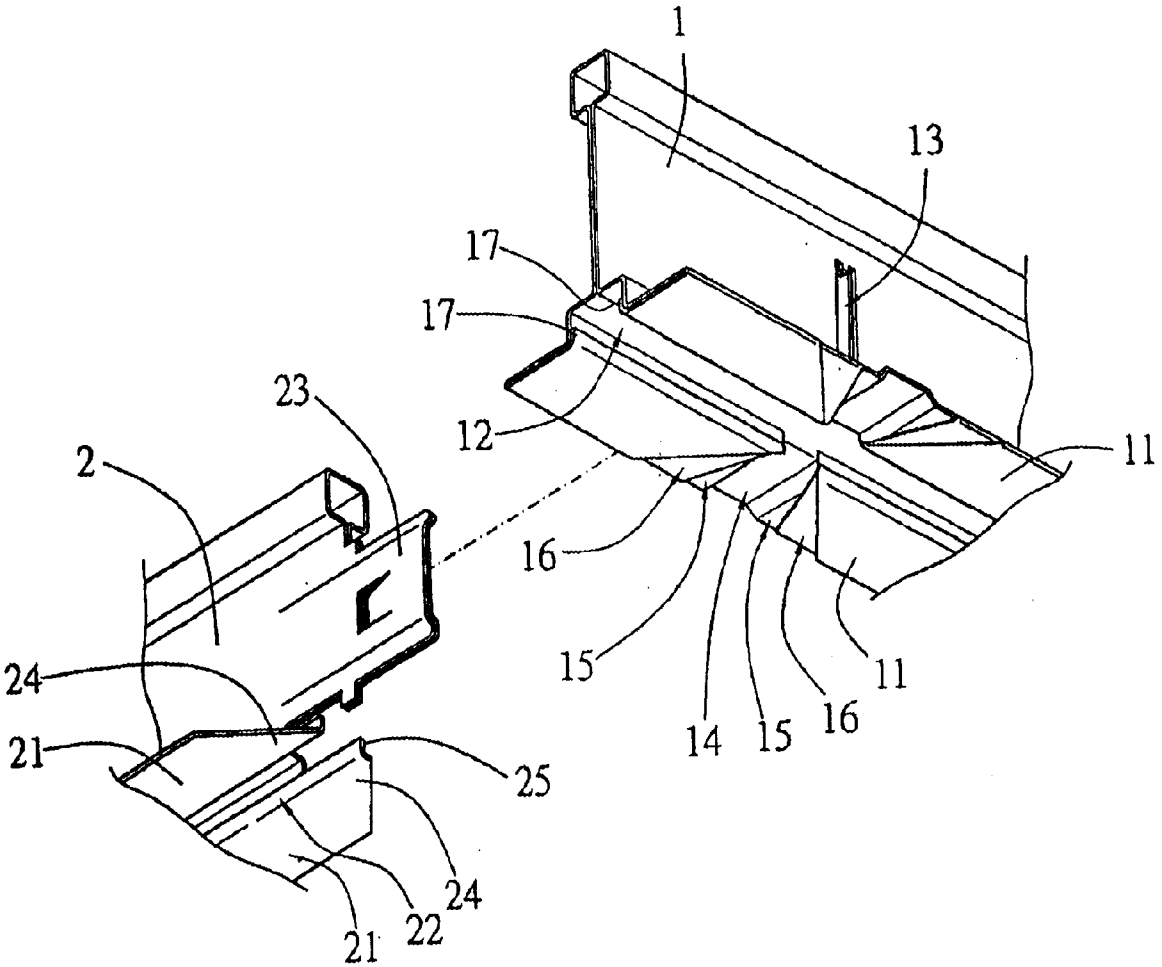
FIG. 4 is another cross section view of the present invention.
Figure 5:
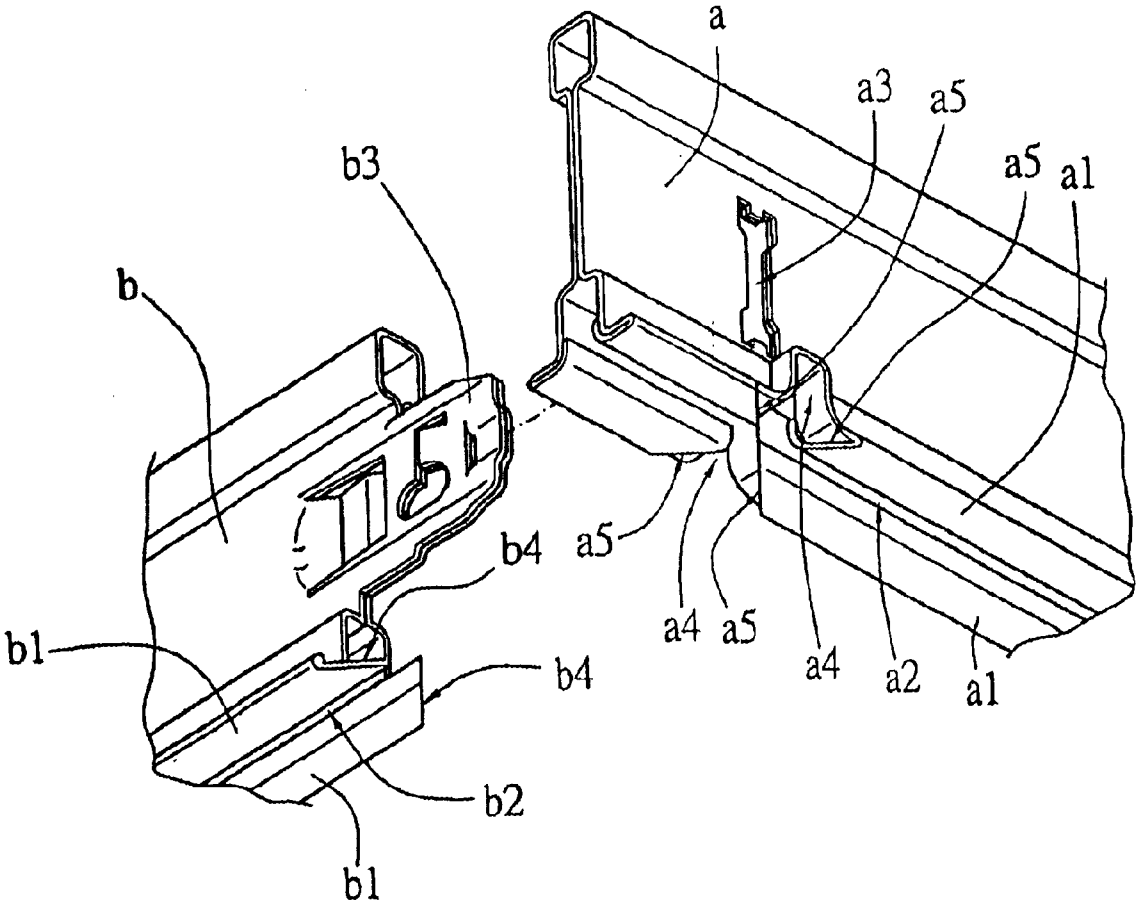
Fig.5 (PRIOR ART)
FIG. 5 is a front view of a prior art embodiment.

The elongated groove 12 and the first oblique fold 15 of the main frame 1 and the elongated groove 22 of the side frame 2 should be painted dark. This is to assure that the construction task is done well or not. While two inserting tongues 23 of two side frames 2 are inserted into the joint slot 13 of a main frame 1, the protrusion 24 of the side frame 2 is inserted into the second oblique fold 16 of the main frame 1. The first oblique fold 15 is matched and covered completely. The quality of construction can be inspected easily by viewing whether Referring to FIG 4, the pairs of flap 21 of the main frame 1 and side frame 2 form elongated groove 12 and 21 on the center bottom respectively. The elongated groove 12 and 22 are bent further to form folded part 17 and 25. An indentation 14 is right beneath the slot joint 13. The angle of the first oblique fold 15 of the indentation 14 of the main frame 1 is less than 45 degrees. The angle of the second oblique fold 16 above the first oblique fold 15 is 45 degrees. When inserting tongue 23 of the side frame is in the joint slot 13 of the main frame 1, the folded part 25 of the side frame 2 can be inside the indentation 14 of the main frame 1. The protrusion 24 of the side frame 2 can also be fixed into the second oblique fold 16 of the main frame 1.

While a preferred embodiment of the invention has been shown and described in detail, it will be readily understood and appreciated that numerous omissions, changes and additions may be made without departing from the spirit and scope of the invention.

What is claimed is:

1. An intersecting lightweight steel frame comprising:

a main frame and a side frame;

flaps located on both sides of a bottom of said main frame and said side frame, pairs of said flaps forming an elongated groove on a center bottom of said main frame and said side frame, respectively;

a joint slot located in a middle of said main frame;

a first oblique fold in said main frame being formed vertically under said joint slot, an angle of said first oblique fold being less than 45 degrees with respect to the joint slot;

an insertion tongue on each of both ends of the side frame;

a protrusion on the end of said flap, an angle of said protrusion being 45 degrees; and a second oblique fold being located above said first oblique fold, an angle of said second oblique being 45 degrees with respect to the joint slot, said protrusion of said side frame matches and attaches firmly with said second oblique fold of said main frame while said first oblique fold reinforces a connection between said main frame and said side forms and prevents twisting of said main frame and said side frame with respect to each other.

2. The vertical intersecting lightweight steel frame recited in claim 1, wherein said flaps are bent inward to form a folded part inside said elongated groove.

* * * * *